US009068248B2

(12) United States Patent
Chen et al.

(10) Patent No.: US 9,068,248 B2
(45) Date of Patent: Jun. 30, 2015

(54) DISTILLATION EQUIPMENT FOR PRODUCING SPONGE TITANIUM

(75) Inventors: Xuemin Chen, Guangdong (CN); Qingdong Ye, Guangdong (CN); Liping Hu, Guangdong (CN); Ming Yin, Guangdong (CN)

(73) Assignee: SHENZHEN SUNXING LIGHT ALLOYS MATERIALS CO., LTD., Shenzhen, Guangdong (CN)

( * ) Notice: Subject to any disclaimer, the term of this patent is extended or adjusted under 35 U.S.C. 154(b) by 196 days.

(21) Appl. No.: 13/585,715

(22) Filed: Aug. 14, 2012

(65) Prior Publication Data

US 2012/0306131 A1 Dec. 6, 2012

(30) Foreign Application Priority Data

Jan. 18, 2012 (CN) ..... 2012 1 0014936

(51) Int. Cl.

| | |
|---|---|
| ***C22B 9/00*** | (2006.01) |
| ***C22B 34/12*** | (2006.01) |
| ***F27B 14/04*** | (2006.01) |
| ***F27B 19/04*** | (2006.01) |

(52) U.S. Cl.

CPC ..... *C22B 34/1277* (2013.01); *F27B 14/04* (2013.01); *F27B 19/04* (2013.01)

(58) Field of Classification Search

CPC ..... C22B 34/1277; F27B 19/04; F27B 14/04
USPC ..... 266/186, 171, 905
See application file for complete search history.

(56) References Cited

U.S. PATENT DOCUMENTS

| | | | | |
|---|---|---|---|---|
| 4,441,925 | A * | 4/1984 | Ishizuka | 75/619 |
| 4,512,557 | A * | 4/1985 | Kimura et al. | 266/171 |
| 2012/0306131 | A1 * | 12/2012 | Chen et al. | 266/186 |

* cited by examiner

*Primary Examiner* — Scott Kastler
(74) *Attorney, Agent, or Firm* — Jackson IPG PLLC; Demian K. Jackson

(57) ABSTRACT

The present invention provides a piece of distillation equipment for producing sponge titanium, which includes a heating furnace and a reactor for containing a condensate, wherein a heating furnace cover is arranged above the heating furnace, a reactor cover is arranged above the reactor, the heating furnace cover is connected with the reactor cover by a pipe, a resistance wire is arranged on the pipe, each lifting device is arranged above the heating furnace cover and the reactor cover, a vacuum-pumping pipe is arranged above a heater cover, and a first metal sealing ring is arranged between the reactor cover and the reactor. The present invention has the beneficial effects that the distillation equipment can ensure normal production, and effectively ensure the quality of sponge titanium product. The problem of distillation tube blockage is solved by adopting a metal gasket.

10 Claims, 1 Drawing Sheet

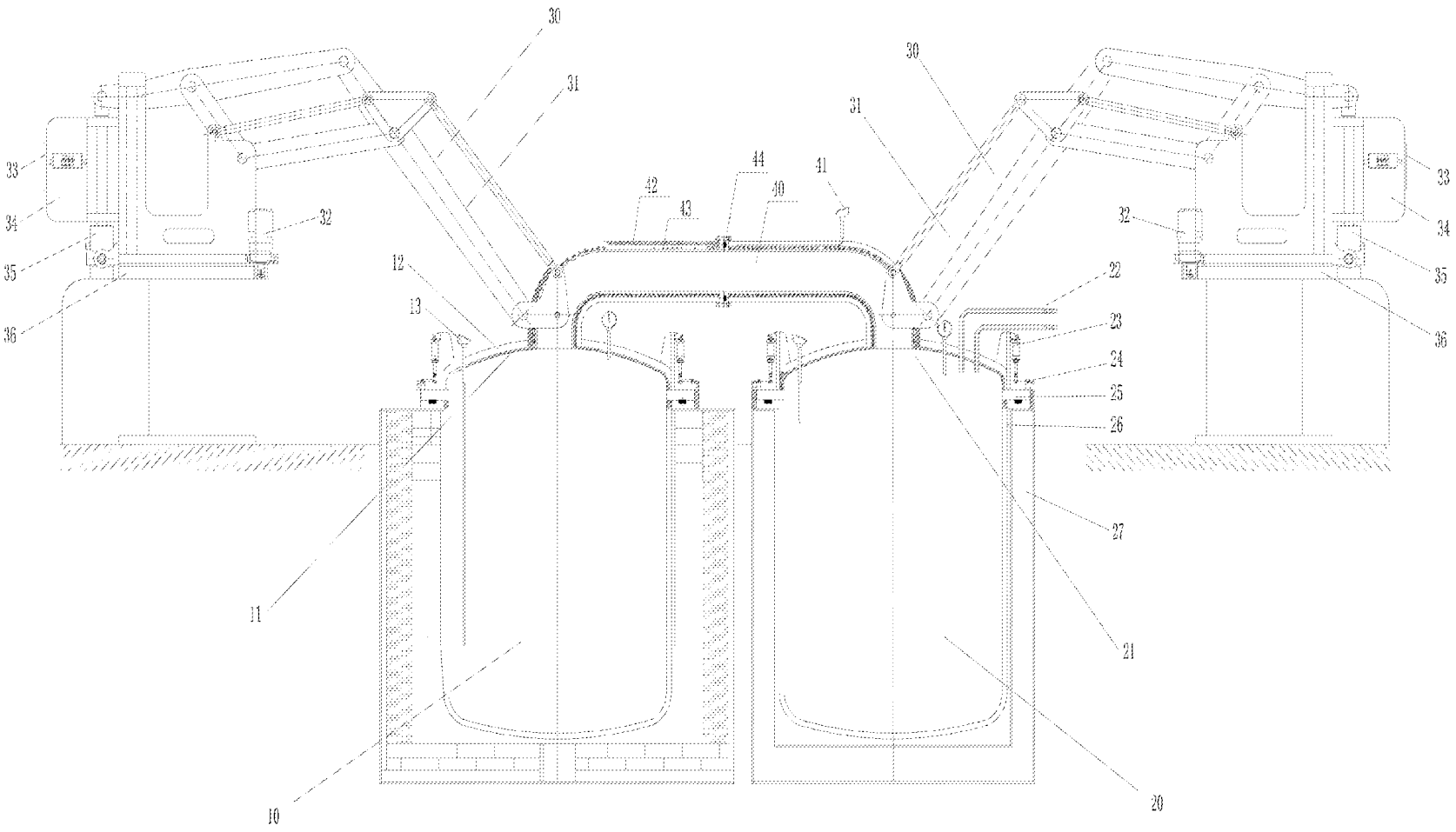
33
34
35
36
32
22
23
24
25
26
27
21
20
30
31
41
40
44
43
42
30
31
12
13
32
11
10
33
34
35
36

DISTILLATION EQUIPMENT FOR PRODUCING SPONGE TITANIUM

BACKGROUND OF THE INVENTION

1. Field of the Invention

The present invention relates to distillation equipment for producing sponge titanium, and in particular to distillation equipment for producing sponge titanium, which is easy to operate and energy-saving.

2. Description of the Related Art

The main technical routes for producing high quality sponge titanium include: 1. studying a process and equipment for preparing high-purity magnesium to enable fine magnesium to reach the requirements for the production of high quality sponge titanium; 2. studying a process and equipment for preparing deeply purified fine titanium tetrachloride to enable the fine titanium tetrachloride to reach the requirements for the production of high quality sponge titanium; 3. studying a process for improving the vacuum degree of a vacuum system and the tightness of reduction distillation equipment; and 4. studying a process and equipment for reduction distillation and finished product breaking to produce a satisfactory high quality sponge titanium.

At present, the production process of sponge titanium at home and abroad mainly adopts a metallothermic reduction process, which in particular refers to preparing metal M from a metal reducing agent (R) and the metal oxide or chloride (MX). Titanium metallurgy methods in which industrial production have been achieved are a magnesiothermic reduction process (Kroll process) and sodiothermic reduction process (Hunter process). Since the Hunter process leads to higher production cost than the Kroll process does, the Kroll process is more widely used in industry currently. The main processes of the Kroll process are that a magnesium ingot is placed into a reactor, heated and melted and thereafter being subjected to oxide films and impurities removal, then titanium tetrachloride ($TiCl_4$) is introduced into the reactor, titanium particles generated by the reaction are deposited, and generated liquid magnesium chloride is discharged promptly through a slag hole. The reaction temperature is usually kept at 800° C. to 900° C., the reaction time is between several hours and several days. Residual metallic magnesium and magnesium chloride in the end product can be removed by washing with hydrochloric acid, and can also be removed by vacuum distillation at 900° C., so as to keep the purity of titanium high. The Kroll process has the disadvantages of high cost, long production cycle, and pollution of the environment, limiting further application and popularization. At present, the process has not changed fundamentally, and still belongs to intermittent production, which fails to realize continuous production, and there is no corresponding improved equipment developed, which is not conducive to further development of sponge titanium manufacturing technology.

SUMMARY OF THE INVENTION

In order to solve the shortcomings of high cost, severe pollution and long production cycle in the prior art, the present invention provides a method for producing sponge titanium including:

Scheme 1: a method for preparing titanium from potassium fluotitanate with aluminothermic reduction process:

Equation Involved:

$$3K_2TiF_6+4Al=3Ti+6KF+4AlF_3$$

Scheme 2: a method for preparing sponge titanium from potassium fluotitanate with magnesiothermic reduction process:

Equation Involved $$K_2TiF_6+2Mg=Ti+2MgF_2+2KF$$

Scheme 3: a method for preparing sponge titanium from potassium fluotitanate with aluminum magnesium thermal reduction process:

Equations Involved:

$$3K_2TiF_6+4Al=3Ti+6KF+4AlF_3$$

$$K_2TiF_6+2Mg=Ti+2MgF_2+2KF$$

Since the potassium fluotitanate, aluminum and magnesium are solids in the raw material, which is different from the traditional production process, the present invention provides distillation equipment for producing sponge titanium, which includes: a heating furnace and a reactor for containing a condensate, wherein a heating furnace cover is arranged above the heating furnace, a reactor cover is arranged above the reactor, the heating furnace cover is connected with the reactor cover by a pipe, a resistance heating wire is arranged on the pipe, at least one lifting device is arranged above the heating furnace cover and the reactor cover, a vacuum-pumping pipe is arranged above a heater cover, and a first metal gasket and a second metal gasket are respectively arranged between two ends of the pipe and the heating furnace cover and the reactor cover.

The present invention, by adopting the above technical schemes, is advantageous in that the pipe is densely provided with resistance heating wires, more particularly the resistance heating wires are arranged at the corner of the pipe, so that during distillation, distilled products do not coagulate in the pipe to avoid blockage, the distillation efficiency is improved, the equipment avoids the cooling of vacuum distillation in the traditional method, saves time and electricity. In addition, each lifting device is arranged above the reactor and the heating furnace, which makes the operation easy and greatly saves labor. Moreover, the product does not come into contact with air, avoiding the possibility that the sponge titanium comes into contact with oxygen and thereby improving the quality of product.

Preferably, the first metal gasket has a softening point of 900° C. and a melting point of 1000° C., and the second metal gasket has a softening point of 1100° C. and a melting point of 1200° C.

The present invention, by further adopting the above technical characteristics, is advantageous in that, in the distillation equipment of the present invention, the temperature in the heating furnace is usually 850° C. to 950° C., the temperature in the reactor is usually 1000° C., and the above metal gasket can be used for further ensuring tightness during distillation and improving the distillation speed.

Preferably, the inner wall of the reactor is provided with a metal crucible and a water-cooling jacket for cooling.

Preferably, the reactor cover is also provided with a locking mechanism fixedly connected with the reactor and a locking cylinder for providing power for the locking mechanism.

The present invention, by further adopting the above technical characteristics, is advantageous in that the reactor is kept under a condition of total sealing to further improve the distillation efficiency.

Preferably, the lifting device includes a vertical lifting structure connected with the reactor cover, a lifting hydraulic cylinder for providing power, and a hydraulic steering motor for adjusting the lifting hydraulic cylinder arranged below the vertical lifting structure.

Preferably, a first thermocouple and an insulation material are arranged on the heating furnace cover.

Preferably, the upper and lower ends of the pipe are provided with metal sealing rings.

Preferably, a touch screen and an electric cabinet for controlling the movement of the lifting device are arranged above the lifting hydraulic cylinder.

Preferably, a pivoting support is arranged below the electric cabinet.

Preferably, the pipe is provided with a second thermocouple, an insulation layer and a heating wire orderly.

The present invention has the beneficial effects that, by adopting the above technical schemes, the production equipment can ensure normal production, and effectively ensure the quality of sponge titanium product. The metal gasket facititates stirring under high temperature, requires no condensation, and solves the problem of distillation tube blockage.

Compared with the prior art, the inventive distillation equipment has low cost, offers environmental protection during production, and the sponge titanium produced by the equipment has a distillation yield almost reaching 100%, which fundamentally solves the problem of the distillation equipment for producing the sponge titanium.

BRIEF DESCRIPTION OF THE DRAWING

FIG. 1 is a structural diagram of one embodiment of equipment for producing sponge titanium in the present invention.

DETAILED DESCRIPTION OF THE EMBODIMENTS

The preferred embodiments of the present invention are further described in detail below:

A piece of equipment for producing sponge titanium, which includes a heating furnace 10 and a reactor 20 for containing a condensate, wherein a heating furnace cover 11 is arranged above the heating furnace 10, a reactor cover 21 is arranged above the reactor 20, the heating furnace cover 11 is connected with the reactor cover 21 by a pipe 40, a resistance heating wire 43 is arranged on the pipe 40, a first and a second lifting device 30 is arranged above the heating furnace cover 11 and above the reactor cover 21 respectively, a vacuum-pumping pipe 22 is arranged above the reactor cover 21, and a first metal gasket and a second metal gasket 25 are respectively arranged between the heating furnace 10 and the heating furnace cover 11 and between the reactor 20 and the reactor cover 21.

The inner wall of the reactor 20 is provided with a metal crucible 26 and a water-cooling jacket 27 for cooling. A first thermocouple 13 and insulation material 12 are arranged on the heating furnace cover 11.

The reactor cover 21 is also provided with a locking mechanism 24 fixedly connected with the reactor 20 and a locking cylinder 23 for providing power for the locking mechanism 24.

Each lifting device 30 includes a vertical lifting structure 31 connected with the heating furnace cover 11 or the reactor cover 21 respectively. A lifting hydraulic cylinder 35 for providing power and a hydraulic steering motor 32 for adjusting the lifting hydraulic cylinder 35 are arranged below the vertical lifting structure 31.

The upper and lower surfaces of the pipe 40 are provided with metal sealing rings 44.

A touch screen 33 and an electric cabinet 34 for controlling the movement of each lifting device 30 are arranged above the respective lifting hydraulic cylinder 35.

A pivoting support 36 is arranged below the electric cabinet 34.

The pipe 40 is provided with a second thermocouple 41 and an insulation layer 42.

Scheme 1: a method for preparing titanium from potassium fluotitanate with an aluminothermic reduction process Equation Involved:

$$3K_2TiF_6+4Al=3Ti+6KF+4AlF_3$$

Embodiment 1

Under a vacuum condition, 36 g of aluminum and 240 g of potassium fluorotitanate are reacted at 800° C.;

in a vacuum state, the reactant is distilled in the heating furnace at 1000° C., the resulting KF and $AlF_3$ are introduced into the reactor through the pipe;

50.22 g of sponge titanium is obtained by keeping the vacuum state after cooling, the content of titanium in the product is 90.8% and the reduction rate is 95%.

Embodiment 2

Under a vacuum condition, 40 g of aluminum and 240 g of potassium fluorotitanate are reacted at 800° C.;

in a vacuum state, the reactant is distilled in the heating furnace at 1000° C., the resulting KF and $AlF_3$ are introduced into the reactor through the pipe;

48.39 g of sponge titanium is obtained by keeping the vacuum state after cooling, the content of titanium in the product is 97% and the reduction rate is 97.8%.

Embodiment 3

Under a vacuum condition, 44 g of aluminum and 240 g of potassium fluorotitanate are reacted at 800° C.;

in a vacuum state, the reactant is distilled in the heating furnace at 1000° C., the resulting KF and $AlF_3$ are introduced into the reactor through the pipe;

48.29 g of sponge titanium is obtained by keeping the vacuum state after cooling, the content of titanium in the product is 98.6% and the reduction rate is 99.2%.

TABLE 1

Distillation test data

| Embodiment | Amount of added raw material, g | | Theoretical Ti quantity, g | Obtained sponge titanium product, g | Ti content of product, % | Reduction rate, % |
|---|---|---|---|---|---|---|
| | $K_2TiF_6$ | Al | | | | |
| 1 | 240 | 36 | 48 | 50.22 | 90.8 | 95 |
| 2 | 240 | 40 | 48 | 48.39 | 97 | 97.8 |
| 3 | 240 | 44 | 48 | 48.29 | 98.6 | 99.2 |

Reduction rate (%)=(obtained sponge titanium product*Ti content of product)/theoretical Ti quantity Scheme 2: a method for preparing sponge titanium from potassium fluotitanate with a magnesiothermic reduction process Equation Involved:

$$K_2TiF_6+2Mg=Ti+2MgF_2+2KF$$

Embodiment 4

Under the condition of vacuum introduction of argon, 48 g of magnesium and 240 g of potassium fluorotitanate are reacted at 750° C.;

in a vacuum state, the reactant is distilled in the heating furnace at 1100° C., the resulting KF and $MgF_2$ and Ti are introduced into the reactor through the pipe;

48.93 g of sponge titanium is obtained by keeping the vacuum state after cooling, the content of titanium in the product is 87.5% and the reduction rate is 89.2%.

Embodiment 5

Under the condition of vacuum introduction of argon, 24 g of magnesium and 240 g of potassium fluorotitanate are reacted at 750° C.;

in a vacuum state, the reactant is distilled in the heating furnace at 1100° C., the resulting KF and $MgF_2$ and Ti are introduced into the reactor through the pipe;

23.90 g of sponge titanium is obtained by keeping the vacuum state after cooling, the content of titanium in the product is 92.5% and the reduction rate is 92.1%.

Embodiment 6

Under the condition of vacuum introduction of argon, 12 g of magnesium and 240 g of potassium fluorotitanate are reacted at 750° C.;

in a vacuum state, the reactant is distilled in the heating furnace at 1100° C., the resulting KF, $MgF_2$ and Ti are introduced into the reactor through the pipe;

11.89 g of sponge titanium is obtained by keeping the vacuum state after cooling, the content of titanium in the product is 99.2% and the reduction rate is 98.3%.

Embodiment 7

Under the condition of vacuum introduction of argon, 6 g of magnesium and 240 g of potassium fluorotitanate are reacted at 750° C.;

in a vacuum state, the reactant is distilled in the heating furnace at 1100° C., the resulting KF, $MgF_2$ and Ti are introduced into the reactor through the pipe;

6.33 g of sponge titanium is obtained by keeping the vacuum state after cooling, the content of titanium in the product is 91.6% and the reduction rate is 96.7%.

TABLE 2

Distillation test data

| Embodiment | Amount of added raw material, g | | Theoretical Ti quantity, g | Obtained sponge titanium product, g | Ti content of product, % | Reduction rate, % |
|---|---|---|---|---|---|---|
| | $K_2TiF_6$ | Mg | | | | |
| 4 | 240 | 48 | 48 | 48.93 | 87.5 | 89.2 |
| 5 | 240 | 24 | 24 | 23.90 | 92.5 | 92.1 |
| 6 | 240 | 12 | 12 | 11.89 | 99.2 | 98.3 |
| 7 | 240 | 6 | 6 | 6.33 | 91.6 | 96.7 |

Scheme 3: a method for preparing sponge titanium from potassium fluorotitanate with aluminum-magnesium thermal reduction process Chemical Equations Involved:

$$3K_2TiF_6+4Al=3Ti+6KF+4AlF_3$$

$$K_2TiF_6+2Mg=Ti+2MgF_2+2KF$$

Embodiment 10

Under the condition of vacuum introduction of argon, 36 g of aluminum, 36 g of magnesium and 240 g of potassium fluorotitanate are reacted at 800° C.;

in a vacuum state, the reactant is distilled in the heating furnace at 1100° C., the resulting KF, $AlF_3$, $MgF_2$ and Ti are introduced into the reactor through the pipe;

45.12 g of sponge titanium is obtained by keeping the vacuum state after cooling, the content of titanium in the product is 96.5% and the reduction rate is 90.7%.

Embodiment 11

Under the condition of vacuum introduction of argon, 36 g of aluminum, 18 g of magnesium and 240 g of potassium fluorotitanate are reacted at 800° C.;

in a vacuum state, the reactant is distilled in the heating furnace at 1100° C., the resulting KF, $AlF_3$, $MgF_2$ and Ti are introduced into the reactor through the pipe;

45.45 g of sponge titanium is obtained by keeping the vacuum state after cooling, the content of titanium in the product is 98% and the reduction rate is 92.8%.

Embodiment 12

Under the condition of vacuum introduction of argon, 36 g of aluminum, 9 g of magnesium and 240 g of potassium fluorotitanate are reacted at 800° C.;

in a vacuum state, the reactant is distilled in the heating furnace at 1100° C., the resulting KF, $AlF_3$, $MgF_2$ and Ti are introduced into the reactor through the pipe;

47.9 g of sponge titanium is obtained by keeping the vacuum state after cooling, the content of titanium in the product is 99.5% and the reduction rate is 99.3%.

Embodiment 13

Under the condition of vacuum introduction of argon, 36 g of aluminum, 2 g of magnesium and 144 g of zinc are mixed, then reacted with 240 g of potassium fluorotitanate at 800° C.;

in a vacuum state, the reactant is distilled in the heating furnace at 1100° C., the resulting KF, $AlF_3$, $MgF_2$ and Ti are introduced into the reactor through the pipe;

48.29 g of sponge titanium is obtained by keeping the vacuum state after cooling, the content of titanium in the product is 98.9% and the reduction rate is 99.5%.

TABLE 3

Distillation test data

| Embodiment | Amount of added raw material, g | | | Theoretical Ti quantity, g | Obtained sponge titanium | Ti content of product, % | Reduction rate, % |
|---|---|---|---|---|---|---|---|
| | $K_2TiF_6$ | Al | Mg | | | | |
| 5 | 240 | 36 | 36 | 48 | 45.12 | 96.5 | 90.7 |
| 6 | 240 | 36 | 18 | 48 | 45.45 | 98 | 92.8 |
| 7 | 240 | 36 | 9 | 48 | 47.9 | 99.5 | 99.3 |
| 8 | 240 | 36 | 2 | 48 | 48.29 | 98.9 | 99.5 |

From the above, we can see that the reduction rate and productivity of the sponge titanium produced by the distillation equipment for producing sponge titanium of the present invention are greatly improved.

The above is the further detailed description made to the invention in conjunction with specific preferred embodiments, but it should not be considered that the specific embodiments of the invention are only limited to the these descriptions. For one of ordinary skill in the art to which the invention belongs, many simple deductions and replacements can be made without departing from the inventive concept. Such deductions and replacements should fall within the scope of protection of the invention.

What is claimed is:

1. Distillation equipment for producing sponge titanium, comprising:

a heating furnace;

a reactor for containing a condensate, a heating furnace cover arranged above the heating furnace, a reactor cover arranged above the reactor, a pipe connecting the heating furnace cover with the reactor cover, a resistance heating wire arranged on the pipe, a first lifting device arranged above the heating furnace cover, a second lifting device arranged above the reactor cover, a vacuum-pumping pipe arranged above the reactor cover, and a first metal gasket and a second metal gasket respectively arranged between the heating furnace and the heating furnace cover and between the reactor and the reactor cover.

2. The distillation equipment for producing sponge titanium according to claim 1, wherein the first metal gasket has a softening point of 900° C. and a melting point of 1000° C., and the second metal gasket has a softening point of 1100° C. and a melting point of 1200° C.

3. The distillation equipment for producing sponge titanium according to claim 1, wherein each lifting device comprises a touch screen and an electric cabinet for controlling the movement of the respective lifting device and arranged above a lifting hydraulic cylinder.

4. The distillation equipment for producing sponge titanium according to claim 3, wherein a pivoting support is arranged below each electric cabinet.

5. The distillation equipment for producing sponge titanium according to claim 1, wherein an inner wall of the reactor is provided with a metal crucible and a water-cooling jacket for cooling.

6. The distillation equipment for producing sponge titanium according to claim 1, wherein the reactor cover is also provided with a locking mechanism fixedly connected with the reactor and a locking cylinder for providing power for the locking mechanism.

7. The distillation equipment for producing sponge titanium according to claim 1, wherein each lifting device comprises a vertical lifting structure connected with the respective cover, a lifting hydraulic cylinder for providing power and a hydraulic steering motor for adjusting the lifting hydraulic cylinder arranged below the vertical lifting structure.

8. The distillation equipment for producing sponge titanium according to claim 1, wherein a first thermocouple and an insulation material are arranged on the heating furnace cover.

9. The distillation equipment for producing sponge titanium according to claim 1, wherein upper and lower surfaces of the pipe are provided with metal sealing rings.

10. The distillation equipment for producing sponge titanium according to claim 9, wherein the pipe is provided with a second thermocouple and an insulation layer.

* * * * *